US005957637A

United States Patent [19]

Savoie

[11] Patent Number: 5,957,637

[45] Date of Patent: Sep. 28, 1999

[54] APPARATUS AND METHOD FOR GENERATING ULTIMATE SURFACES ON OPHTHALMIC LENSES

[75] Inventor: Marc Y. Savoie, Moncton, Canada

[73] Assignee: Micro Optics Design Corp., Irvine, Calif.

[21] Appl. No.: 08/969,766

[22] Filed: Nov. 13, 1997

[51] Int. Cl.[6] ..... B23C 1/30

[52] U.S. Cl. ..... 409/132; 409/200; 451/42

[58] Field of Search ..... 409/131, 132, 409/165, 167, 166, 200, 199, 201, 211; 451/42, 43, 232, 279, 236, 280

[56] References Cited

U.S. PATENT DOCUMENTS

| | | | |
|---|---|---|---|
| 3,458,956 | 8/1969 | Suddarth . | |
| 4,068,413 | 1/1978 | Suddarth . | |
| 4,419,846 | 12/1983 | Schimitzek . | |
| 4,493,168 | 1/1985 | Field . | |
| 4,574,527 | 3/1986 | Craxton . | |
| 4,653,233 | 3/1987 | Brueck . | |
| 4,664,570 | 5/1987 | Tsukiji et al. | 409/132 |
| 4,760,672 | 8/1988 | Darcangelo et al. | 451/42 |
| 4,866,884 | 9/1989 | Smith . | |
| 4,908,997 | 3/1990 | Field . | |
| 4,947,715 | 8/1990 | Council, Jr. | 451/42 |
| 4,987,668 | 1/1991 | Roesch | 409/165 |
| 4,989,316 | 2/1991 | Logan et al. | 451/42 |
| 5,181,345 | 1/1993 | Kulan . | |
| 5,321,915 | 6/1994 | Lecerf et al. | 451/240 |
| 5,431,514 | 7/1995 | Saito et al. | 409/132 |
| 5,485,771 | 1/1996 | Brennan . | |
| 5,580,198 | 12/1996 | Saeki et al. | 409/199 |
| 5,688,084 | 11/1997 | Fritz et. al. | 409/235 |

*Primary Examiner*—Andrea L. Pitts
*Assistant Examiner*—Adesh Bhargava
*Attorney, Agent, or Firm*—Mario D. Theriault

[57] ABSTRACT

The apparatus comprises a base having orthogonal horizontal longitudinal axis, horizontal transversal axis and vertical axis, and a tool spindle having a motor and a lens surfacing tool mounted on a rotatable arbour of the motor. The apparatus also comprises a lens holder having a chuck for retaining an ophthalmic lens with a perimeter thereof defining a plane being substantially perpendicular to the longitudinal axis. A first linear slide is affixed to the base and has a first movable support and a first actuator for moving the first movable support along the longitudinal axis. A second linear slide is also affixed to the base and has a second movable support supporting the lens holder and a second actuator for moving the second movable support and the lens holder along the transversal axis. A rotary table is affixed to the first movable support and supports the tool spindle. The rotary table has a third actuator for rotating the rotary table about the vertical axis. A computer is provided for simultaneously controlling displacements of the first, second and third actuators, whereby the first, second and third actuators are operable in a compound mode for enhancing the precision of the movements of the lens surfacing tool in a direction normal to the ophthalmic lens.

20 Claims, 9 Drawing Sheets

APPARATUS AND METHOD FOR GENERATING ULTIMATE SURFACES ON OPHTHALMIC LENSES

FIELD OF THE INVENTION

The present invention relates to an apparatus for generating a final surface on an ophthalmic lens in a single operation. The present invention also relates to a method for operating an ophthalmic lens generating apparatus wherein the movement of the surface generating tool along the axis of lens is a mechanically-advantaged movement.

BACKGROUND OF THE INVENTION

A first type of general ophthalmic lens generating apparatus has a cup-shaped abrading tool repeatedly sweeping across the surface of a lens blank until the prescribed curvature is obtained. The cup-shaped abrading tool is affixed to a slide plate movably mounted on a swing arm. The center of rotation of the swing arm is movable towards and away from a lens blank holder and the length of the swing arm is adjustable. The slide plate is movable about a pivot which is coaxial with the center of radius of the edge of the abrading cup. The base curve on the ophthalmic lens is determined by the length of the swing arm, and the cross curve is determined by the angular relationship of the abrading tool relative to the axis of the lens blank.

Various inventions pertaining to ophthalmic lens generating apparatus of the first type are illustrated and described in the following U.S. Patents:

U.S. Pat. No. 3,458,956 issued on Aug. 5, 1969 to J. M. Suddarth et al;

U.S. Pat. No. 4,068,413 issued on Jan. 17, 1978 to J. M. Suddarth;

U.S. Pat. No. 4,419,846 issued on Dec. 13, 1983 to G. Schimitzek et al;

U.S. Pat. No. 4,574,527 issued on Mar. 11, 1986 to R. S. Craxton;

U.S. Pat. No. 4,653,233 issued on Mar. 31, 1987 to E. Brueck;

U.S. Pat. No. 4,866,884 issued on Sep. 19, 1989 to K. L. Smith et al;

U.S. Pat. No. 5,181,345 issued on Jan. 26, 1993 to S. Kulan.

A second type of ophthalmic lens generating apparatus of the prior art is characterized by the use of a computer and linear servo-actuators for moving the tool or the lens holder during the lens generating process. The prescribed curvature on the ophthalmic lens is obtained by interpolating and simultaneously guiding the motions of the linear actuators.

Examples of computer-controlled lens generating apparatus of the prior art are provided in the following U.S. Patents:

U.S. Pat. No. 4,493,168 issued on Jan. 15, 1985 to E. L. Field, Jr.;

U.S. Pat. No. 4,908,997 issued on Mar. 20, 1990 to E. L. Field, Jr. et al;

U.S. Pat. No. 5,485,771 issued on Jan. 23, 1996 to Brennan et al.

In the lens generating apparatus of the first type, the advance of the abrading tool towards the surface of the lens is directly related to the extension of the swing arm or to the height of the arc defined by the sweeping of the tool against the surface of the lens blank. Similarly, in the computer-controlled lens generating apparatus, the precision of a displacement of the abrading tool in a direction generally perpendicular to a plane defined by a lens blank is directly related to a smallest increment of the linear actuator moving the tool in this direction. Therefore, any defect in the mechanism for articulating or extending the swing arm in the apparatus of the first type as well as any defect in the linear actuators of a computer-controlled apparatus has a direct effect on the quality of the surface being generated by these machines.

Although ultra-smooth mechanisms and servo-actuators are available commercially, the level of precision required by the optical industry generally exceeds the most stringent precision requirement by industrial sectors. Consequently, it has been generally accepted that an ophthalmic lens generated on the apparatus of the prior art requires extensive fining and polishing of the surface of the lens for correcting focal errors in the generated lens and for obtaining a proper transparency of the lens' surface.

SUMMARY OF THE INVENTION

In the present invention, however, there is provided a lens generating apparatus wherein the precision thereof is enhanced by compounding the movements of a rotary actuator and one or more linear actuators for greatly increasing the displacements of the linear actuators relative to the actual movement of the lens surfacing tool.

In a first aspect of the present invention, the apparatus comprises a base having orthogonal horizontal longitudinal axis, horizontal transversal axis and a vertical axis, a tool spindle having a motor and a lens surfacing tool mounted on a rotatable arbor of the motor for rotation by the motor, and a lens holder having a chuck for retaining an ophthalmic lens with a perimeter thereof defining a plane being substantially perpendicular to the horizontal longitudinal axis. The apparatus of the present invention also comprises a first linear slide means affixed to the base and having a first movable support and a first linear actuator connected to the first movable support for moving the first movable support along the horizontal longitudinal axis. There is also provided a rotary table affixed to the first movable support and supporting the tool spindle. The rotary table has a rotary actuator connected thereto for rotating the tool spindle about the vertical axis. The apparatus of the present invention further has a computer having means for simultaneously controlling displacements of the first and rotary actuators.

The lens surfacing tool of the apparatus of the present invention has a working circumference and a plurality of cutters affixed to the working circumference. The working circumference has a cutting side for contacting the surface of the ophthalmic lens. The tool spindle is mounted on the rotary table with the cutting side of the lens surfacing tool being disposed at a nominal radius from the vertical axis.

A primary advantage of the apparatus of the present invention is that when the lens holder is positioned aside the horizontal longitudinal axis and the first and rotary actuators are operated simultaneously for moving the cutting side of the lens surfacing tool across a surface of the ophthalmic lens, along a prescribed base curve for the ophthalmic lens, a total displacement of the first movable support along the longitudinal axis is greater than the depth of the base curve in the ophthalmic lens. Therefore, an actual output increment of the lens surfacing tool along the horizontal longitudinal axis is smaller than a rated input increment of the first linear actuator. Actually, when the ophthalmic lens is a circular lens having a diameter of about 70 mm and the nominal radius between the cutting side of the tool and the vertical axis is about 205 mm, the total displacement of the first movable support along the horizontal longitudinal axis is about between 50 and 80 times larger than the depth of the base curve in the ophthalmic lens.

In another aspect of the present invention, the lens generating apparatus also has a second linear slide affixed to the base and having a second movable support supporting the lens holder, and a second linear actuator connected to the second movable support for moving the second movable support and the lens holder along the horizontal transversal axis.

In some instances the second linear actuator may also be operated simultaneously with the rotary and first linear actuators for reducing the displacement of the cutting side of the lens surfacing tool relative to the surface of the lens along the horizontal transversal axis. As will be explained later, when the second linear actuator is operated, the sum of the displacement of the cutting side of the lens surfacing tool along the horizontal transversal axis plus the displacement of the ophthalmic lens along this transversal axis is about between 1.0 and 4.0 times more than the width of the ophthalmic lens.

In a further aspect of the present invention, there is provided a novel method for operating the apparatus of the present invention wherein the precision thereof is enhanced. This method comprises the steps of:

a) moving the lens holder near a far end of the second linear slide with the ophthalmic lens being positioned on one side of the horizontal longitudinal axis and having a far edge and a near edge relative to the horizontal longitudinal axis;
b) rotating the rotary table such that the rotatable arbor of the tool spindle is oriented in a vicinity of a parallel alignment with the horizontal transversal axis;
c) moving the first movable support such that the cutting side of the lens surfacing tool is near one of the far and near edges of the ophthalmic lens;
d) rotating the lens surfacing tool and moving the first movable support for moving the cutting side of the lens surfacing tool in contact with the ophthalmic lens;
e) simultaneously rotating the rotary table and actuating the first linear actuator for sweeping the cutting side of the lens surfacing tool along a prescribed base curve across the optical surface of the ophthalmic lens.

An advantage of the novel method of the present invention is that when the rotatable arbor of the tool spindle is oriented in the vicinity of a parallel alignment with the horizontal transversal axis, a displacement of the first movable support for partly subtracting a component of an arcuated displacement of the lens surfacing tool about the vertical axis, along the horizontal longitudinal axis, for maintaining the cutting side of the lens surfacing tool within the prescribed base curve, is much larger than an actual depth of the prescribed base curve in the ophthalmic lens. A precision in the movement of the lens surfacing tool is thereby greatly enhanced.

BRIEF DESCRIPTION OF THE DRAWINGS

The preferred embodiment of the present invention will be further understood from the following description, with reference to the drawings in which.

DETAILED DESCRIPTION OF THE PREFERRED EMBODIMENT

The preamble to this section provides an overview of the operation of ophthalmic lens surfacing equipment of the prior art. This overview is presented here to refresh the reader's memory of these toric surface generators and to better describe a common drawback of these machines. Typical toric surface generators of the prior art, and especially those which are controlled by computer are illustrated in FIGS. 1, 2 and 3.

Figure 1:
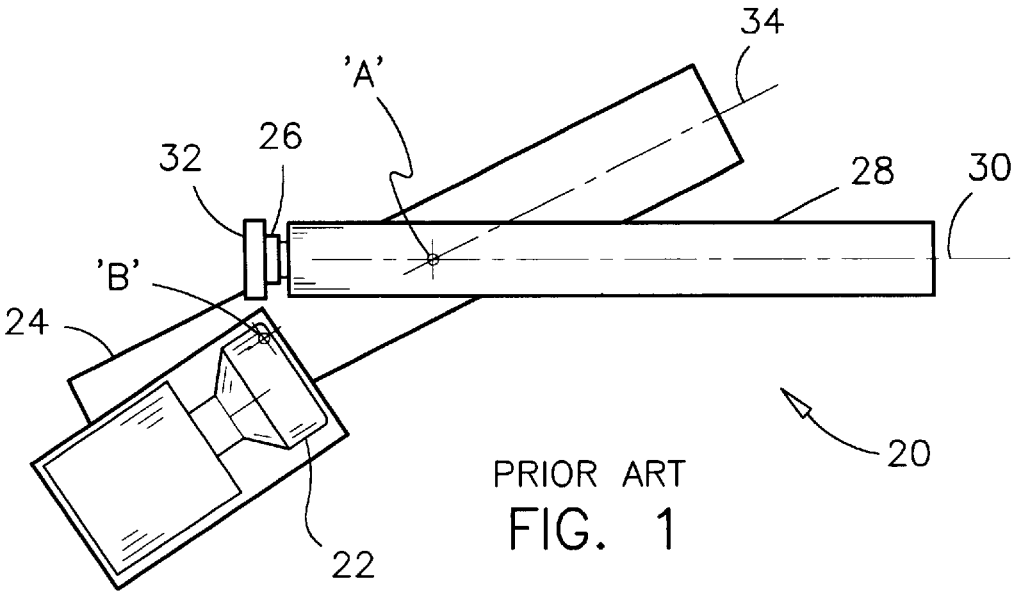
PRIOR ART FIG. 1
FIG. 1 is a schematic plan view of a first type of toric surface generator of the prior art.

The toric surface generator 20 which is partly illustrated in FIG. 1, has a cup-shaped cutter wheel 22 which is adjustably mounted on a headstock 24. The machine also has a lens holder 26 mounted on a tailstock 28. The cutter wheel 22 is swept across the longitudinal axis 30 of the tailstock about pivot 'A' for example, for shaping the surface of the lens blank 32. Pivot 'B' and the cutter wheel 22 are movable along the axis 34 of the headstock 24. The position of the lens blank 32 is also adjustable along the longitudinal axis 30 of the tailstock. During each cut, the inclination of the cutter wheel 22 about pivot 'B', and its position relative to the lens blank 32, and the position of the lens blank 32 along the axis 30, may be continually changed.

The movements of both the headstock 24 and tailstock 28 are driven by a respective stepper motor and lead screw (not shown). A computer controller is used to operate the stepper motors for cutting both convex and concave toric lenses.

Figure 2:
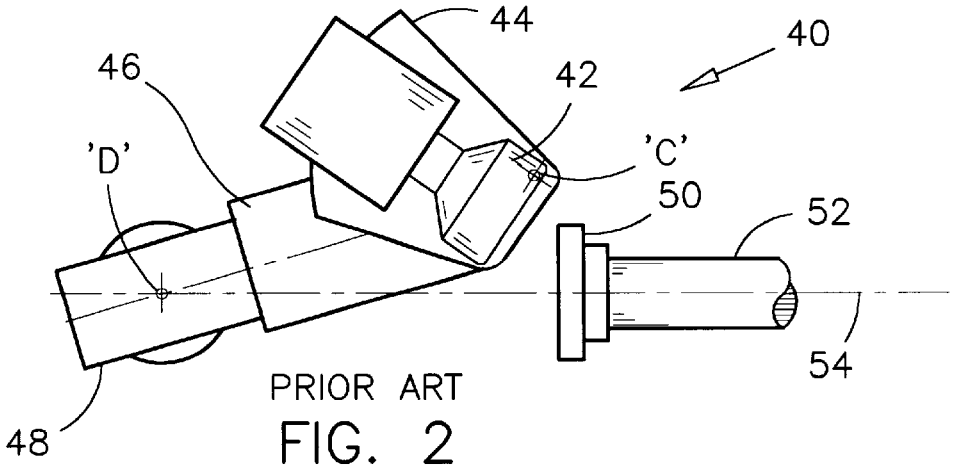
PRIOR ART FIG. 2
FIG. 2 is a schematic plan view of a second type of toric surface generator of the prior art.
Figure 3:
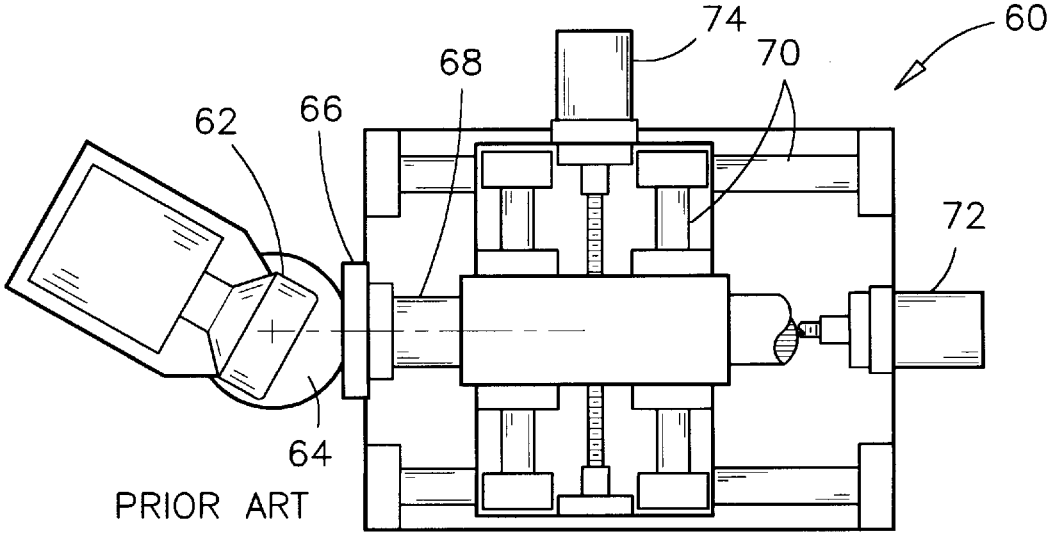
PRIOR ART FIG. 3
FIG. 3 is a schematic plan view of a third type of toric surface generator of the prior art.
Figure 4:
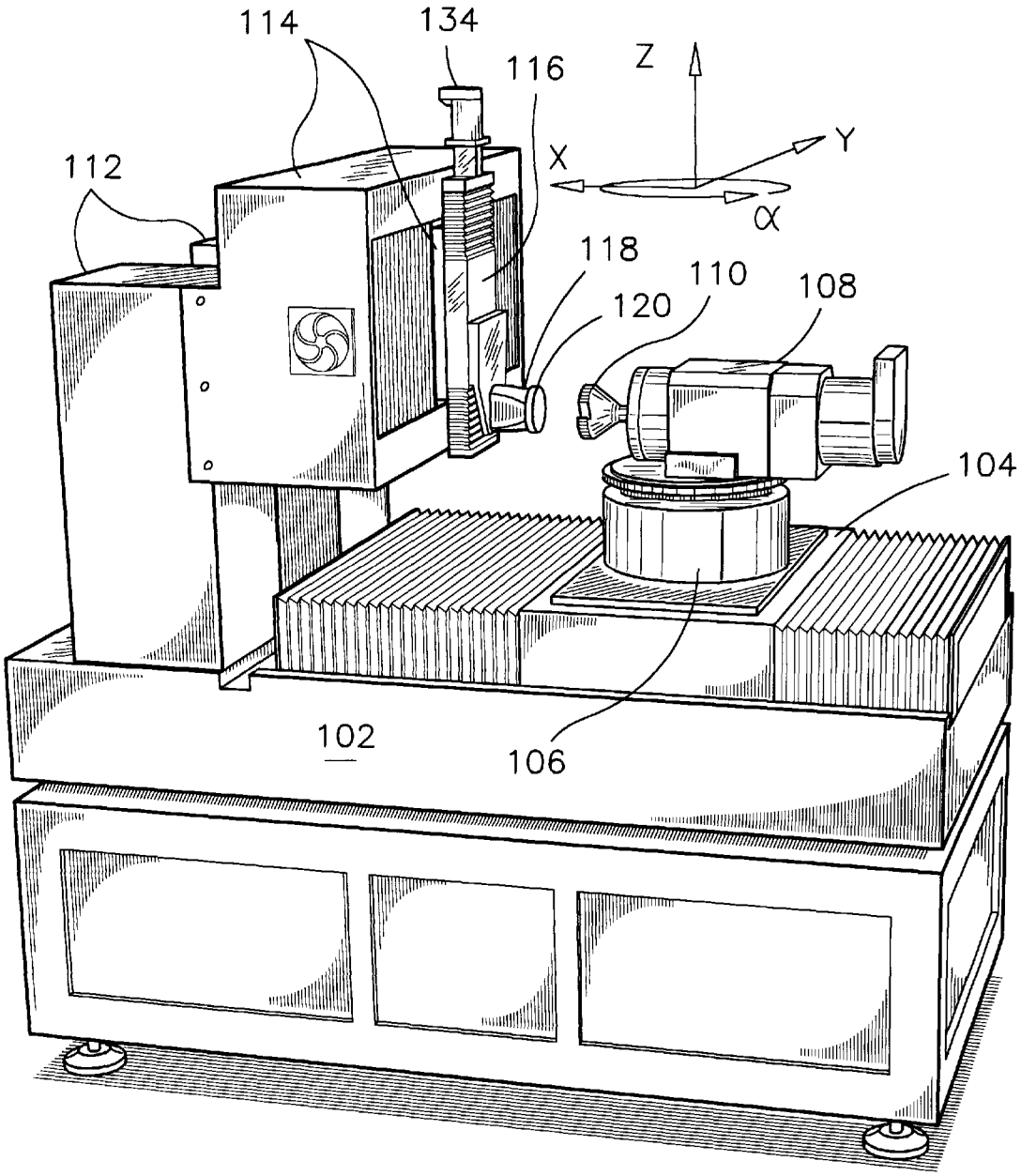
FIG. 4 is a front, left side and top perspective view of the ophthalmic lens generating apparatus of the preferred embodiment.
Figure 5:
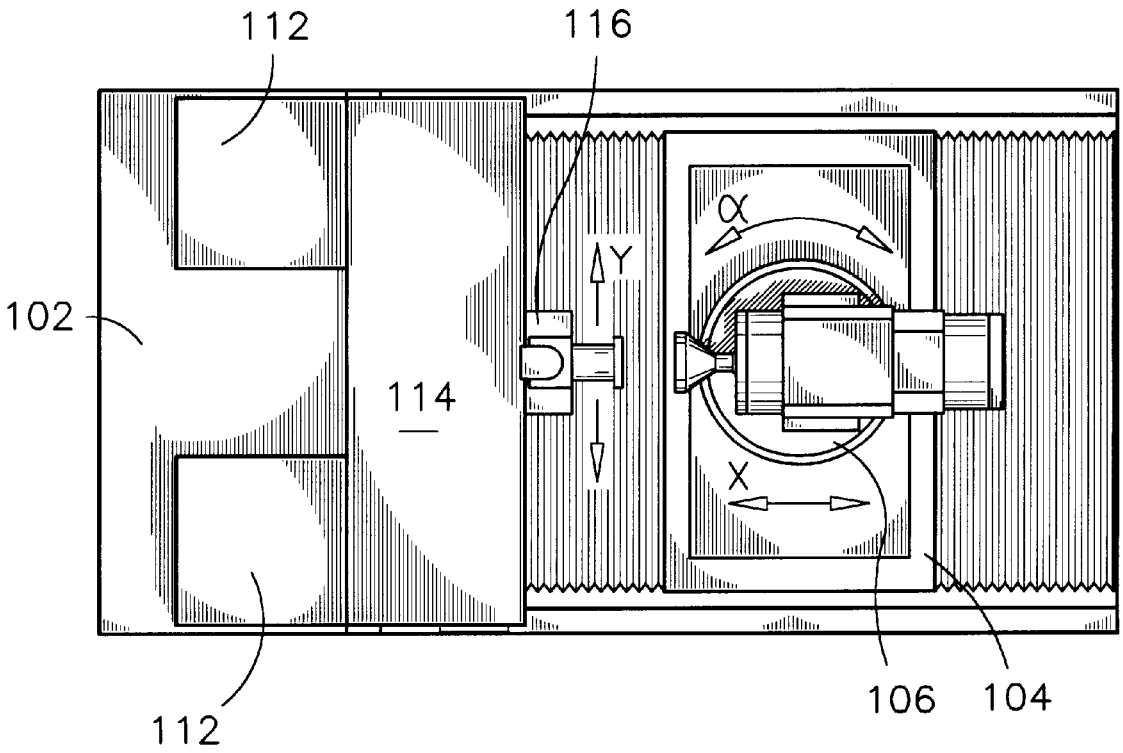
FIG. 5 is a top plan view of the ophthalmic lens generating apparatus of the preferred embodiment.
Figure 7:
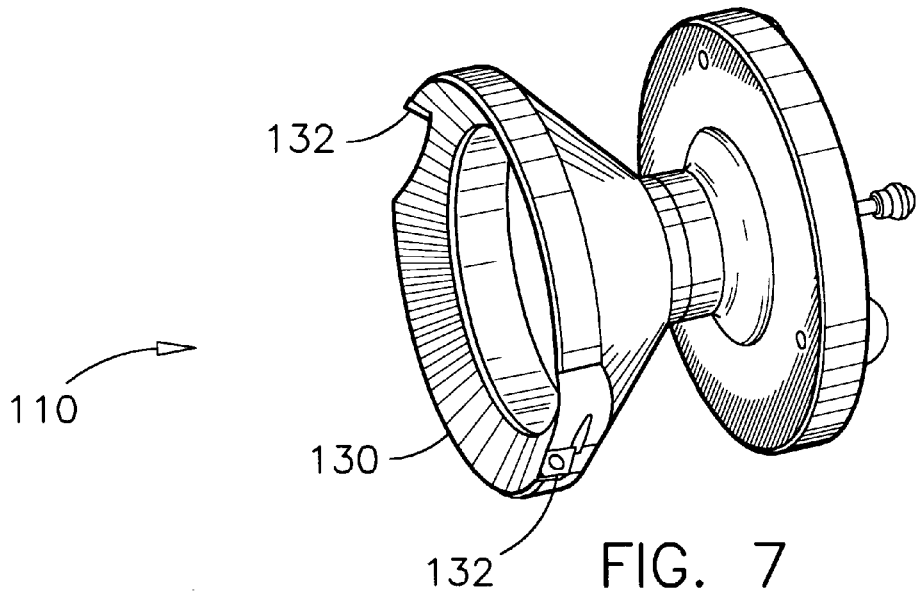
FIG. 7 is a, driven end and top perspective view of a typical surface generating tool used on the ophthalmic lens generating apparatus of the preferred embodiment.
Figure 6:
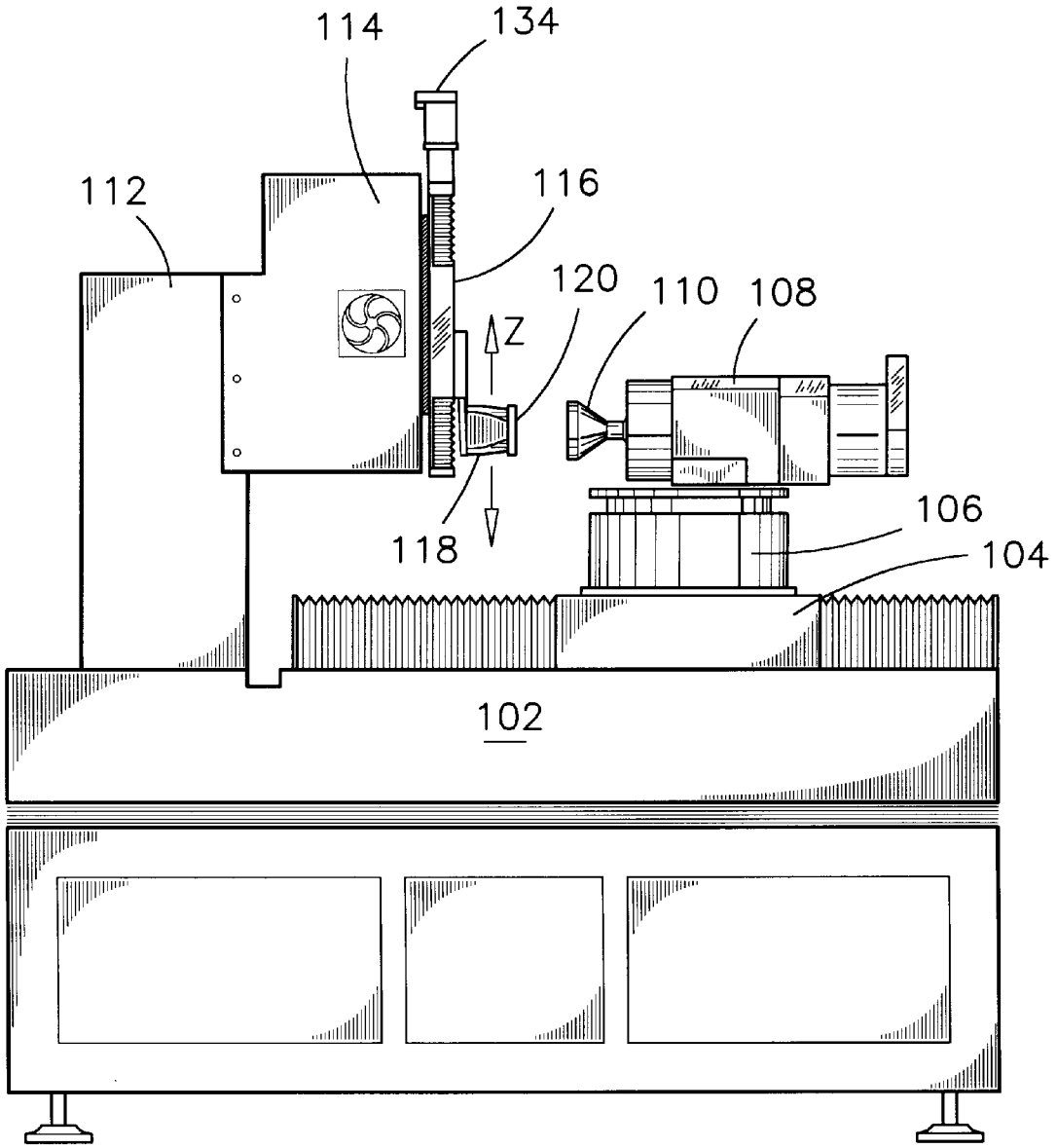
FIG. 6 is a left side elevation view of the ophthalmic lens generating apparatus of the preferred embodiment.

In the example of FIG. 2, the lens grinding apparatus 40 illustrated therein has a cup-shaped cutter tool 42 which is mounted on a cross slide 44. The cross slide 44 is mounted on a base slide 46 and is adjustable relative to the base slide 46 about pivot 'C', for controlling the head angle of the tool 42. A sweep platform 48 is connected to the base slide 46 and is rotatable about pivot 'D'. The position of the base slide 46 relative to the sweep platform 48 is adjustable for changing the radius of the prescribed base curvature on the lens.

The lens blank 50 is mountable on a tailstock 52 which is also movable along the longitudinal axis 54 of the apparatus. The extension and retraction of the base slide 46 and the rotation of the cross slide 44 and the sweep platform 48 are controlled by a microprocessor and servomechanisms.

In the third example of toric surface generators of the prior art, FIG. 3 illustrates a computer-controlled lens generator 60 having a cup-shaped tool 62 which is adjustably mounted on a turning base 64. A lens blank 66 is mountable in a lens holder 68. The lens holder 68 is mounted on a X-Y table comprising linear ball bushing bearings (not shown), two pairs of round ways 70, a X-axis linear actuator 72 and a Y-axis linear actuator 74. The turning base 64 and X-Y table are simultaneously operable for controlling the relative movement of the lens blank 66 and the tool 62 for obtaining the prescribed lens curvatures.

In the light of the above review of the computer-controlled ophthalmic lens generating apparatus of the prior art, it will be appreciated that the precision of the cross curve on a generated lens is defined primarily by the shape and inclination of the cup-shaped tool relative to the lens surface. In that respect, it will also be appreciated that the diameter of the tool is a fixed value and the inclination of the tool is effected generally by mechanisms having significant leverage or mechanical advantage. The precision of the cross curve is therefore only partly addressed hereinbelow.

The precision of the base curve, however, is directly related to the precision of the servo-actuators or stepper motors and lead screws controlling the advance of the tool in a direction perpendicular to the plane of the lens blank. The displacement of the tool in a direction normal to the plane of the lens blank is generally very small, and any irregularities in a lead screw and a low resolution of the servo-actuator moving the tool are directly transposed as defects on the surface of the lens.

In the computer-controlled apparatus of the prior art, the movement of the linear actuators in the axial direction relative to the lens blank and the depth of cut in that lens blank are substantially equal values. That is, a movement of about one increment by the servo-actuator controlling the base curve will cause the tool to advance about one increment towards the lens blank. It is therefore candidly asserted that a ratio of the axial displacement of the servo-actuators of the apparatus of the prior art over the depth of cut made by the tools represents a value of about 1 to 1.

It is known in the field of computer-controlled machinery that the precision of a servo-actuator is dependent on the resolution of the encoder controlling its position. For example, a typical modern optical encoder can provide a resolution of up to 2000 counts per revolution. When this encoder is part of a servo-actuator connected to a lead screw having a thread pitch of 5 millimeters for example, the resolution of each count represents an increment of 2.5 microns on the ball nut mounted on that screw. The theoretical resolution of this exemplified system is therefore ±2.5 microns. Such precision is considered outstanding in the field of metalworking and robotic for example.

It is also known in the field of computer-controlled machinery that a curve surface milled or ground in a workpiece is made of a plurality of straight segments wherein the number of segments is proportional to the number of discrete positions from the encoder monitoring the position of the tool. It will also be appreciated that a CNC milling or grinding machine with an axis drive having a low resolution encoder will generate broadly facetted surfaces on a workpiece. Concurrently, a high resolution encoder produces a greater number of segments, thus better approximating a true curve.

In the field of optics, however, a surface-figure-type defect having an amplitude of 0.05 micron, (50 nanometers) or sometimes smaller, is visible on an ophthalmic lens if the period of that defect is in the range of 1 millimeter for example. For reference purposes, acceptable surface-figure defects are sometimes determined in this industry by the formula: $A=K*\lambda^2$; where A is the amplitude of the surface-figure defect in micron; K is an industry constant, and $\lambda$ is half the period of the defect in micron.

Because of the stringent requirements by the optical industry, modern servo-mechanisms are challenged beyond expectations when precisely controlling, in a direct connection mode, the axial displacement of a lens surfacing tool towards and away from a lens blank. Therefore, the equipment of the prior art has been used generally for grinding lenses to approximated prescribed curves. Lapping and polishing equipment are later used for fining the surfaces of the lenses to an acceptable optical surface finish.

Referring now to FIGS. 4–7, the apparatus of the preferred embodiment is illustrated therein. The apparatus of the preferred embodiment comprises a massive granite base 102 supporting a first slide table 104 which is movable along the longitudinal axis of the apparatus, hereinafter referred to as the X-axis. A rotary table 106 is mounted on the first slide table 104. The rotary table 106 is rotatable about a designated Z-axis, in a direction designated by a in FIG. 4. A tool spindle 108 is mounted on the rotary table 106 and has a cup-shaped cutting tool 110 affixed to the arbor thereof The apparatus of the preferred embodiment also comprises a pair of upright massive granite blocks 112 mounted on one end of the granite base 102. A second slide table 114 is affixed to the upright granite blocks 112 and is movable horizontally in a direction perpendicular to the longitudinal axis, hereinafter referred to as the Y-axis. The second slide table 114 supports a third slide table 116 and a lens holder 118, in which an ophthalmic lens blank 120 is mountable. The third slide table 116 is movable vertically along the designated Z-axis.

The cutting tool 110 comprises a cup-shaped body 130 having at least two cutter inserts 132 made of a material containing tungsten-carbide or similar elements. The outside diameter of the cutting tool 110 is generally around 125 or 150 millimeters.

The slide tables 104, 114, and 116 and the rotary table 106 are preferably mounted on high precision pressurized fluid bearings. The slide tables are actuated by high-precision, linear-type servo-actuators. Since such fluid bearings and linear servo-actuators are well-known generally, they have not been illustrated, except for reference purposes, part of the actuator of the third slide table as indicated by numeral 134 in FIGS. 4 and 6.

Although these types of fluid bearings and linear servo-drives are known generally in the field of high-precision machining, these equipment are rarely used in ophthalmic lens generating equipment. The use of such linear actuators and fluid bearings in the apparatus of the preferred embodiment has been found to be an outstanding substitute for the conventional lead screw and servo-motor drives. The inherent defects of the conventional lead screw and servo-motor drives are numerous and include the eccentricity of ball nut, backlash, thread irregularities and flexion in the lead screws. These problems are practically nonexistent with linear servo-actuators and pressurized fluid bearings.

The preferred method of operation of the apparatus of the preferred embodiment is illustrated in the examples of FIGS. 8–12. In FIGS. 8A, 8B, 8C and 8D for example, the initial position in the tool spindle 108 at the beginning of a cut is represented in FIG. 8A. The final position of the tool spindle 108 at the end of a cut is illustrated in FIG. 8B. The cutting of the lens surface is done by rotating the rotary table 106 in the clockwise direction when looking at the apparatus from the top. The engagement of the cutting tool 110 with the lens blank 120 during a cut is effected starting at the far edge of the lens blank 120 and moving through the surface of the lens blank 120 toward the inside edge of the lens blank 120. The cutting tool 110 typically contacts the lens blank 120 in a retracting, back-of-the-hand-type-motion against the surface of the lens blank 120, although a forward movement is also possible.

Figure 8A:
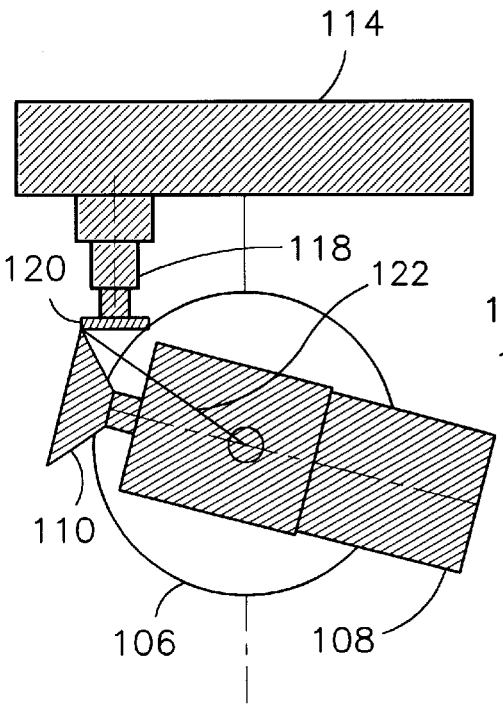
FIG. 8A is a schematic plan view of the apparatus of the preferred embodiment showing the position of the tool spindle at the beginning of a cut relative to the lens blank, in a first example of a lens generating process.
Figure 8B:
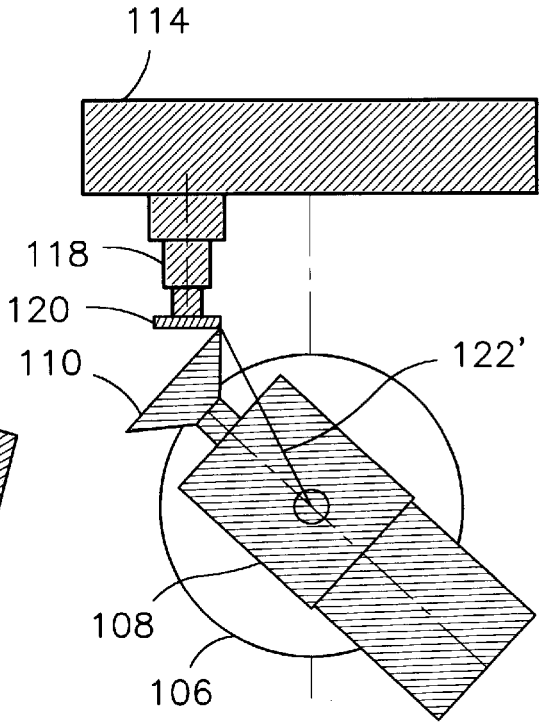
FIG. 8B is a schematic plan view of the apparatus of the preferred embodiment showing the position of the tool spindle at the end of a cut relative to the lens blank in the first example of a lens generating process.
Figure 8C:
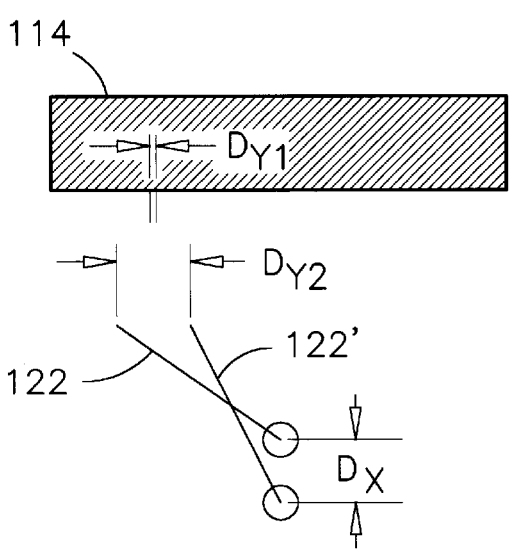
FIG. 8C is a superimposed illustration of the positions of the tool spindle and of the lens blank at the start and at the end of the cut of the first example of a lens generating process.

Referring now to FIG. 8C, there is illustrated therein the initial and final positions of the lens holder 118 along the second slide 114. The initial and final positions of the lens holder 118 are indicated by a dimension label $D_{Y1}$. FIG. 8C also illustrates the initial and final positions of the cutting edge of the tool 110 and the initial and final positions of the rotary table 106 along the X-axis of the apparatus of the preferred embodiment. The initial and final positions of the cutting edge of the tool 110 are separated by the dimension label $D_{Y2}$, and the initial and final positions of the rotary table 106 are separated by the dimension label $D_X$.

The cutting edge of the tool 110 of the apparatus of the preferred embodiment is spaced from the vertical axis, or the center of rotation of the rotary table 106, a nominal radius indicated by numeral 122. The length of the radius 122 contributes to the advantages of the apparatus of the preferred embodiment over equipment of the prior art as will be explained in the next pages.

Figure 8D:
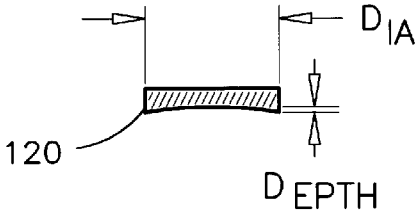
FIG. 8D illustrates for reference purposes the diameter of the lens blank, and the depth of cut corresponding to the dioper value of the base curve in the lens generating process of the first example.

FIG. 8D illustrates the diameter $D_{IA}$ of the lens blank used for the example of FIGS. 8A and 8B, and the depth of the cut $D_{EPTH}$ corresponding to the diopter value of the base curve cut in that lens.

The following Tables 1, 2 and 3 provide data and results for the example of FIGS. 8A, 8B, 8C and 8D, as well as for four additional examples carried out with different lens curvatures. The four additional examples are illustrated respectively in FIGS. 9A–12D. Table 1 shows the diopter values of the base curves and cross curves, and the corresponding radii of the base curves in millimeter, for the five examples. The radii of the base curves were calculated according to the following formula:

Radius in millimeter=1000*(refractive index−1)/Diopter value of the base curve. A refractive index of 1.53 (tool index) was used in the calculations.

The examples are demonstrated with a cutting tool 110 having a diameter of 152.4 mm, a lens blank 120 having a diameter of 70 mm and a radius 122 between the cutting edge of the lens surfacing tool and the center of rotation of the rotary table of about 205 mm. Table 2 and 3 illustrate the recorded values for $D_{EPTH}$, $D_X$, $D_Y$, and $D_{Y2}$ corresponding to each example.

TABLE 1

Figure 9A:
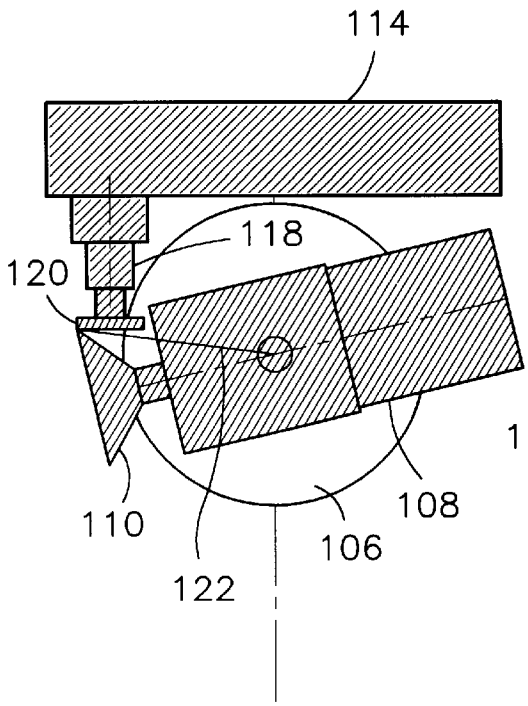
FIG. 9A is a schematic plan view of the apparatus of the preferred embodiment showing the position of the tool spindle at the beginning of a cut relative to the lens blank, in a second example of a lens generating process.
Figure 9B:
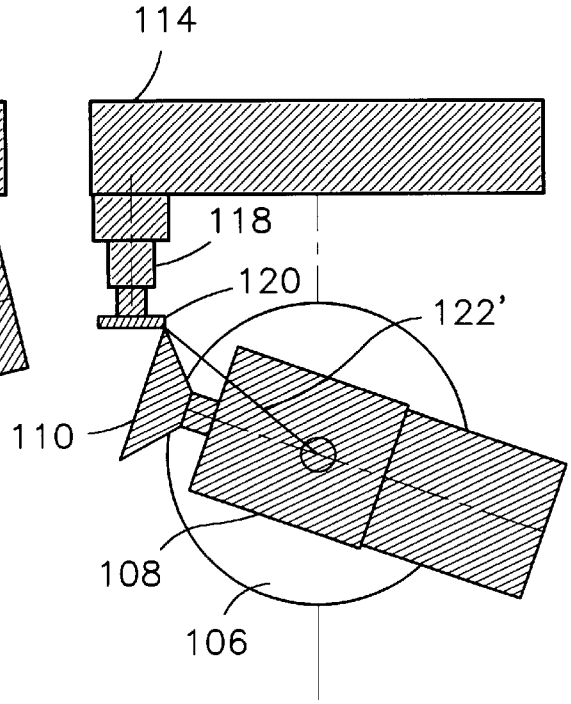
FIG. 9B is a schematic plan view of the apparatus of the preferred embodiment showing the position of the tool spindle at the end of a cut relative to the lens blank in the second example of a lens generating process.
Figure 9C:
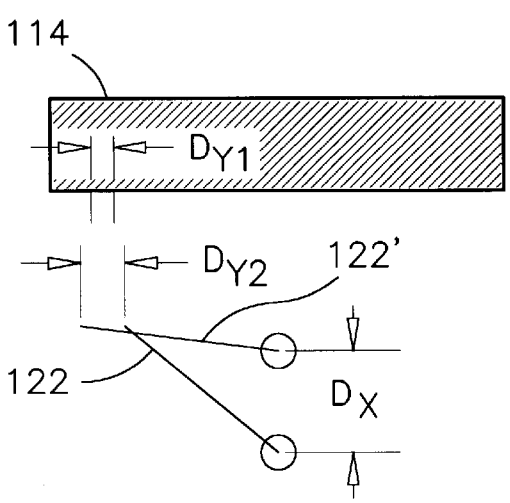
FIG. 9C is a superimposed illustration of the positions of the tool spindle and of the lens blank at the start and at the end of the cut of the second example of a lens generating process.
Figure 9D:
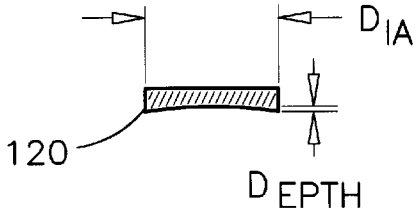
FIG. 9D illustrates for reference purposes the diameter of the lens blank, and the depth of cut corresponding to the dioper value of the base curve in the lens generating process of the second example.
Figure 10A:
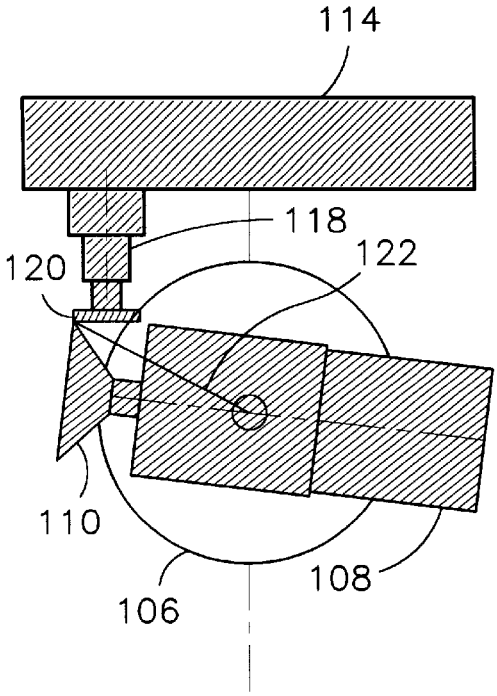
FIG. 10A is a schematic plan view of the apparatus of the preferred embodiment showing the position of the tool spindle at the beginning of a cut relative to the lens blank, in a third example of a lens generating process.
Figure 10B:
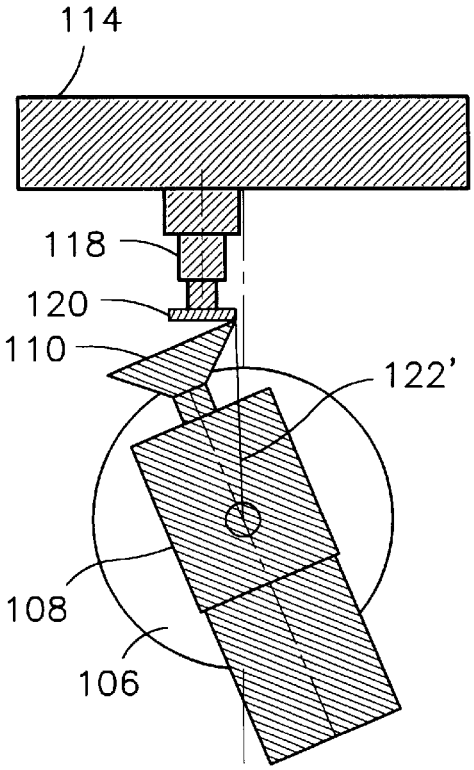
FIG. 10B is a schematic plan view of the apparatus of the preferred embodiment showing the position of the tool spindle at the end of a cut relative to the lens blank in the third example of a lens generating process.
Figure 10C:
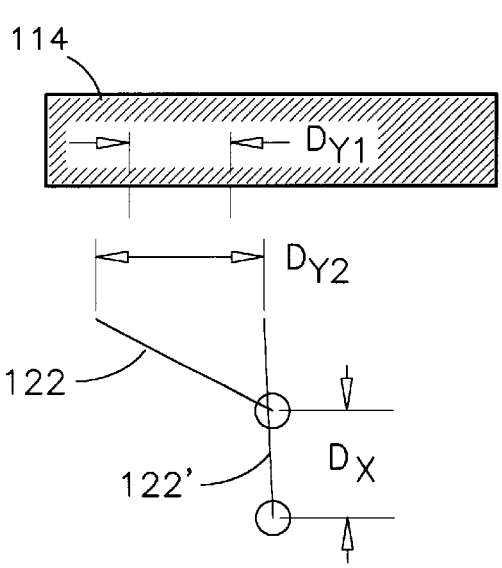
FIG. 10C is a superimposed illustration of the positions of the tool spindle and of the lens blank at the start and at the end of the cut of the third example of a lens generating process.
Figure 10D:
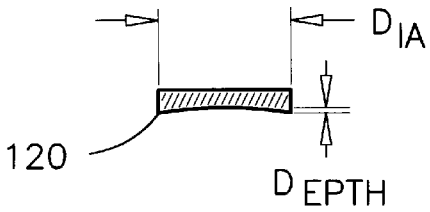
FIG. 10D illustrates for reference purposes the diameter of the lens blank, and the depth of cut corresponding to the dioper value of the base curve in the lens generating process of the third example.
Figure 11A:
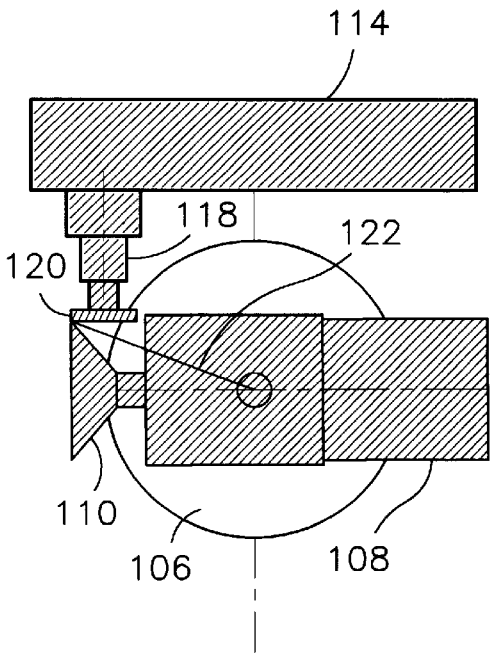
FIG. 11A is a schematic plan view of the apparatus of the preferred embodiment showing the position of the tool spindle at the beginning of a cut relative to the lens blank, in a fourth example of a lens generating process.
Figure 11B:
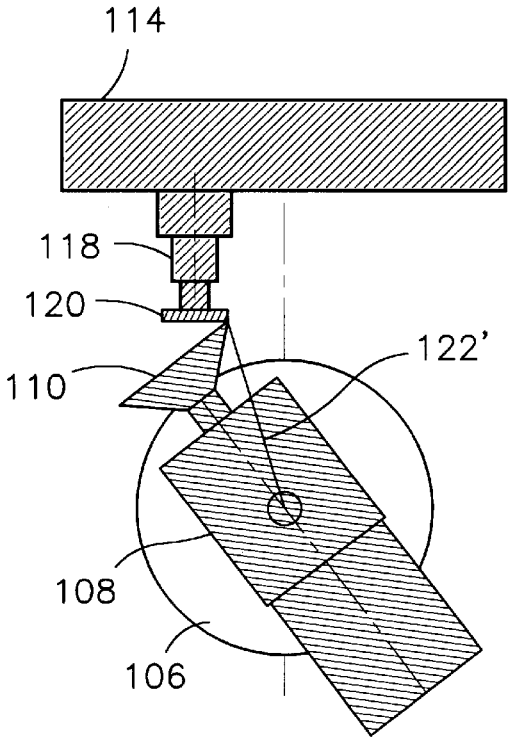
FIG. 11B is a schematic plan view of the apparatus of the preferred embodiment showing the position of the tool spindle at the end of a cut relative to the lens blank in the fourth example of a lens generating process.
Figure 11C:
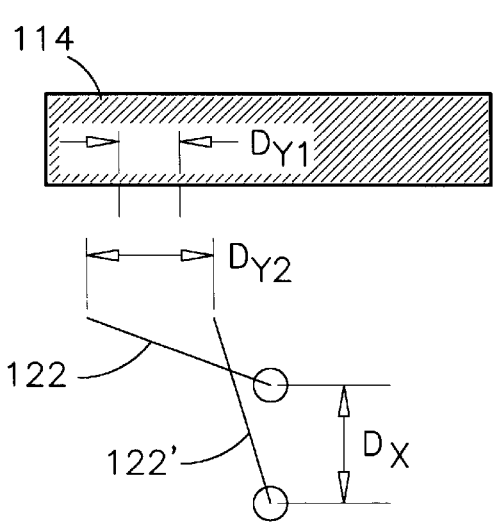
FIG. 11C is a superimposed illustration of the positions of the tool spindle and of the lens blank at the start and at the end of the cut of the fourth example of a lens generating process.
Figure 11D:
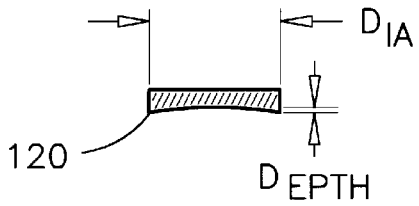
FIG. 11D illustrates for reference purposes the diameter of the lens blank, and the depth of cut corresponding to the dioper value of the base curve in the lens generating process of the fourth example.
Figure 12A:
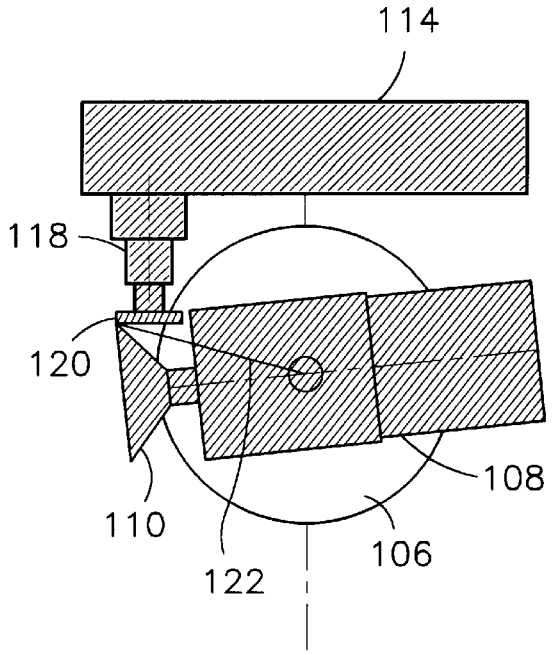
FIG. 12A is a schematic plan view of the apparatus of the preferred embodiment showing the position of the tool spindle at the beginning of a cut relative to the lens blank, in a fifth example of a lens generating process.
Figure 12B:
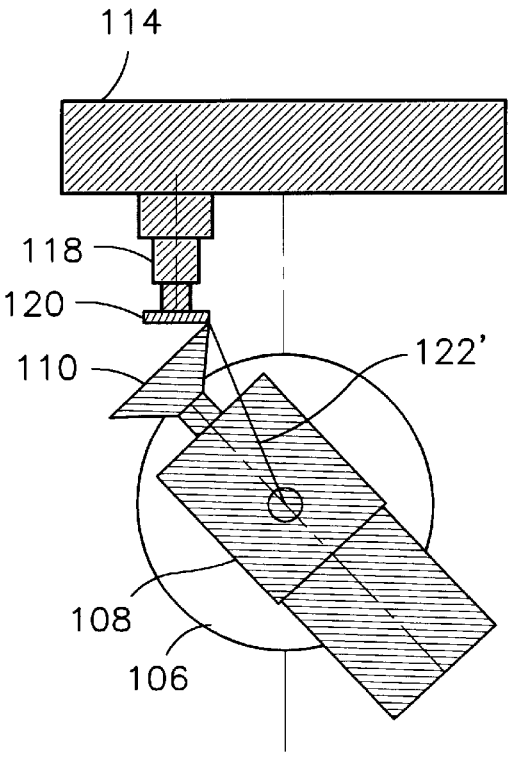
FIG. 12B is a schematic plan view of the apparatus of the preferred embodiment showing the position of the tool spindle at the end of a cut relative to the lens blank in the fifth example of a lens generating process.
Figure 12C:
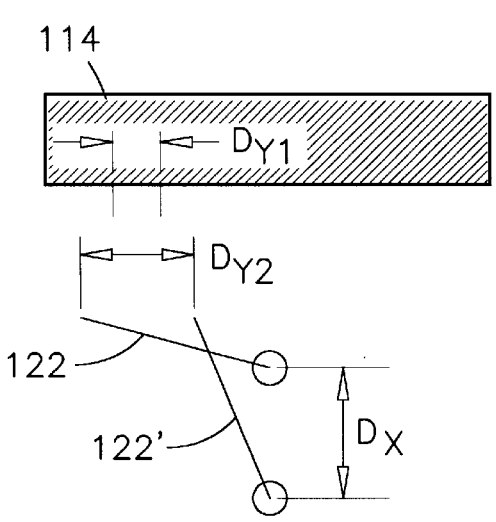
FIG. 12C is a superimposed illustration of the positions of the tool spindle and of the lens blank at the start and at the end of the cut of the fifth example of a lens generating process.
Figure 12D:
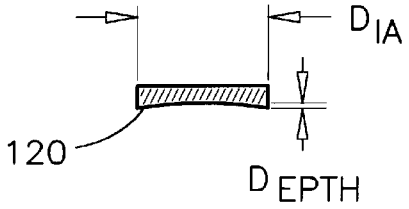
FIG. 12D illustrates for reference purposes the diameter of the lens blank, and the depth of cut corresponding to the dioper value of the base curve in the lens generating process of the fifth example.

| Examples | Diopter Base curve | Diopter Cross curve | Radius* Base curve |
|---|---|---|---|
| FIG. 8C | −3.54 | −6.25 | 149.7 |
| FIG. 9C | −4.00 | −7.19 | 132.5 |
| FIG. 10C | −7.29 | −8.10 | 72.6 |
| FIG. 11C | −6.40 | −6.40 | 82.8 |
| FIG. 12C | −6.37 | −9.56 | 83.2 |

TABLE 2

| Examples | * $D_{epth}$ | * $D_x$ | X-ratio ($D_x/D_{epth}$) |
|---|---|---|---|
| FIG. 8C | 1.0 | 64.0 | 64.0/1 |
| FIG. 9C | 1.2 | 100.6 | 83.8/1 |
| FIG. 10C | 2.1 | 108.2 | 51.5/1 |
| FIG. 11C | 1.9 | 122.1 | 64.2/1 |
| FIG. 12C | 1.8 | 134.1 | 74.5/1 |

TABLE 3

| Examples | * $D_{Y1}$ | * $D_{Y2}$ | Y-ratio ($(D_{Y1} + D_{Y2})/D_{ia}$) |
|---|---|---|---|
| FIG. 8C | 6.5 | 78.1 | 1.2/1 |
| FIG. 9C | 22.1 | 47.8 | 1.0/1 |
| FIG. 10C | 107.2 | 176.9 | 4.1/1 |
| FIG. 11C | 65.5 | 135.6 | 2.9/1 |
| FIG. 12C | 52.7 | 122.3 | 2.5/1 |

*These dimensions are expressed in millimeters.

A ratio of the total displacement $D_X$ of the rotary table 106 along the X-axis over the depth of cut $D_{EPTH}$ in the lens blank is also shown in Table 2. It is important to observe that the values of this ratio range between 50/1 and 80/1. For comparison purposes, the aforesaid corresponding ratio for the machines of the prior art is about 1/1.

The precision of the apparatus of the preferred embodiment in the generation of a base curve in a lens blank is thereby greatly advantaged over the apparatus of the prior art. The advance of the tool towards the lens surface is a compound movement of the rotary table and the retracting movement of a linear actuator of the X-axis. The result of that compound movement is that the increments by which the tool is advanced towards the lens blank is about between 50 and 80 times smaller than the nominal increment of the servo-actuator controlling the movement of the tool along the X-axis. Hence, the resolution of the servo-actuator controlling the X-axis is enhanced by the same factor.

The compound movement of the tool 110 along the X-axis greatly explains the outstanding surface qualities which are obtainable on the ophthalmic lenses generated by the apparatus of the preferred embodiment. The surfaces generated by the apparatus of the preferred embodiment are a final finish, and no further polishing is required.

Referring now to Table 3, there is illustrated therein the Y-ratio representing the sum of the displacement of the tool 110 and the lens holder 118 along the Y-axis of the apparatus divided by the diameter of the lens blank 120. The sweeping the tool 110 across the surface of the lens blank 120 is also a compound movement of the rotary table 106 and the linear servo-actuator of the Y-axis. The Y-ratio of Table 3 indicates that in the examples of FIGS. 8–12, the total number of programmed increments transmitted to both actuators is in most cases larger than the actual number of increments contained in the diameter of the lens blank 120. Therefore, the resolution of both actuators controlling the Y-axis is similarly enhanced. This feature also contributes to some degrees to providing the outstanding surface quality on the ophthalmic lens generated by the apparatus of the preferred embodiment.

Other advantages of the compound movements of the cutting tool 110 include the ability of the apparatus of the preferred embodiment to generate a multitude of surfaces on optical lenses. To name a few, the apparatus of the preferred embodiment can generate concave and convex surfaces, flat surfaces, toroidal surfaces, straight cylindrical surfaces, saddle point surfaces, variable toroidal, elliptical toroidal or other complex surfaces. The apparatus of the preferred embodiment can also add prism to a generated lens without inclining the lens relative to its axis.

While the above description provides a full and complete disclosure of the preferred embodiment of this invention, various modifications, alternate constructions and equivalents may be employed without departing from the true spirit and scope of the invention. Such changes might involve alternate materials, components, structural arrangements, sizes, construction features or the like. Therefore, the above description and the illustrations should not be construed as limiting the scope of the present invention which is defined by the appended claims.

I claim:

1. An apparatus for generating an optical surface on an ophthalmic lens, comprising:

a base having orthogonal horizontal longitudinal axis, horizontal transversal axis and a vertical axis, a tool spindle having a motor and a lens surfacing tool mounted on a rotatable arbor of said motor for rotation by said motor;

lens holder means having chuck means for retaining an ophthalmic lens with a perimeter thereof defining a plane being substantially perpendicular to said horizontal longitudinal axis, first linear slide means affixed to said base and having first movable support means and first linear actuator means connected to said first movable support means for moving said first movable support means along said horizontal longitudinal axis;

second linear slide means also affixed to said base and having second movable support means supporting said lens holder means and second linear actuator means connected to said second movable support means for moving said second movable support means and said lens holder means along said horizontal transversal axis;

rotary table means affixed to said first movable support means and supporting said tool spindle, said rotary table means having a rotary actuator means connected thereto for rotating said tool spindle about said vertical axis;

computer having means for simultaneously controlling displacements of said first, second and rotary actuator means;

said lens surfacing tool having a working circumference and cutter means affixed to said working circumference; said working circumference having a cutting side for contacting said ophthalmic lens;

said tool spindle being mounted on said rotary table means with said cutting side of said lens surfacing tool being disposed at a nominal radius from said vertical axis;

whereby when said lens holder is positioned aside from said horizontal longitudinal axis along said second linear slide means, and when said first, second and rotary actuator means are operated simultaneously for moving said cutting side across said ophthalmic lens, along a prescribed base curve in said ophthalmic lens, a total displacement of said first movable support means along said horizontal longitudinal axis is greater than a depth of said base curve in said ophthalmic lens, and a sum of a total displacement of said cutting side along said horizontal transversal axis and a total displacement of said lens holder along said horizontal transversal axis is equal or greater than a width of said ophthalmic lens measured along said horizontal transversal axis.

2. The apparatus for generating an optical surface on an ophthalmic lens as claimed in claim 1 wherein said ophthalmic lens is a circular lens having a diameter of about 70 mm, said nominal radius is about 205 mm, said total displacement of said first movable support means along said horizontal longitudinal axis is about between 50 and 80 times larger than said depth of said prescribed base curve in said ophthalmic lens, and said sum of a total displacement of said cutting side along said horizontal transversal axis and a total displacement of said lens holder along said horizontal transversal axis is about between 1.0 and 4.0 times said diameter of said ophthalmic lens.

3. The apparatus for generating an optical surface on an ophthalmic lens as claimed in claim 1 wherein said lens surfacing tool comprises a cup-shaped body having at least two cutter inserts mounted on said working circumference thereof.

4. The apparatus for generating an optical surface on an ophthalmic lens as claimed in claim 3 wherein said cup-shaped body has an outside diameter of about between 125 and 150 mm and said nominal radius between said cutting side and said vertical axis is about 205 mm.

5. The apparatus for generating an optical surface on an ophthalmic lens as claimed in claim 4, wherein said rotary table has sufficient rotational range for orienting said rotatable arbor along a vicinity of said horizontal transversal axis.

6. The apparatus for generating an optical surface on an ophthalmic lens as claimed in claim 5 wherein said second linear slide means has sufficient length for accommodating a working of said ophthalmic lens by said lens surfacing tool when said rotatable arbor is oriented along said vicinity of said horizontal transversal axis.

7. The apparatus for generating an optical surface on an ophthalmic lens as claimed in claim 1 wherein said first and second linear slide means comprise high-precision pressurized fluid bearings and said first and said second linear actuator means comprise high-precision linear-type servo-actuators.

8. The apparatus for generating an optical surface on an ophthalmic lens as claimed in claim 1 further comprising a third linear slide means affixed to said second movable support means and having third movable support means connected to said lens holder means and third linear actuator means connected to said third movable support means for moving said third movable support means and said lens holder means along said vertical axis.

9. A method for operating an apparatus for generating an optical surface on an ophthalmic lens comprising:

a base having orthogonal horizontal longitudinal axis, horizontal transversal axis and a vertical axis;

a tool spindle having a motor and a lens surfacing tool mounted on a rotatable arbor of said motor for rotation by said motor;

said lens surfacing tool having a working circumference and cutter means affixed to said working circumference; said working circumference having a cutting side for contacting said ophthalmic lens and said cutting side being mounted at a nominal radius from said vertical axis;

lens holder means having chuck means for retaining said ophthalmic lens with a perimeter thereof defining a plane being substantially perpendicular to said longitudinal axis, first linear slide means affixed to said base and having first movable support means and first linear actuator means connected to said first movable support means for moving said first movable support means along said horizontal longitudinal axis;

second linear slide means also affixed to said base and having second movable support means supporting said lens holder means and second linear actuator means connected to said second movable support means for moving said second movable support means and said lens holder means along said horizontal transversal axis;

said second linear slide means having a nominal travel, a midpoint near said horizontal longitudinal axis, and first and second far ends away from said horizontal longitudinal axis; said nominal travel being about twice as long as said nominal radius;

third linear slide means having a third movable support affixed to said second linear slide means and to said lens holder and a third linear actuator means connected to said third movable support means for moving said third movable support means and lens holder up and down relative to said lens surfacing tool;

rotary table means affixed to said first movable support means and supporting said tool spindle, said rotary table means having a rotary actuator means connected thereto for rotating said tool spindle about said vertical axis;

computer having means for simultaneously controlling displacements of said first, second, third and rotary actuator means;

said method comprising the following steps:

moving said lens holder near said first far end of said second linear slide means, with said ophthalmic lens being positioned on one side of said horizontal longitudinal axis and having a far edge and a near edge relative to said horizontal longitudinal axis;

rotating said rotary table such that said rotatable arbor of said tool spindle is oriented in a vicinity of a parallel alignment with said horizontal transversal axis;

moving said first movable support means such that said cutting side of said lens surfacing tool is near one of said far and near edges of said ophthalmic lens;

rotating said lens surfacing tool and moving said first movable support means for moving said cutting side of said lens surfacing tool in contact with said ophthalmic lens;

simultaneously rotating said rotary table and actuating said first linear actuator means for sweeping said cutting side of said lens surfacing tool along a prescribed base curve across said ophthalmic lens;

whereby when said rotatable arbor is oriented in said vicinity of a parallel alignment with said horizontal transversal axis, a displacement of said first movable support means for partly subtracting a component of an arcuated displacement of said lens surfacing tool about said vertical axis along said horizontal longitudinal axis, for maintaining said cutting side of said lens surfacing tool within said prescribed base curve, is much larger than an actual depth of said prescribed base curve in said ophthalmic lens, and an actual output increment of said lens surfacing tool in a direction normal to said ophthalmic lens is much smaller than an input increment of said first linear actuator means.

10. The method for operating an apparatus for generating an optical surface on an ophthalmic lens as claimed in claim 9 wherein said step of rotating said rotary table such that said rotatable arbor is oriented in a vicinity of said horizontal transversal axis is effected before sweeping said cutting side of said lens surfacing tool across said ophthalmic lens, and said step of simultaneously rotating said rotary table and actuating said first linear actuator means for sweeping said cutting side of said lens surfacing tool along a prescribed base curve across said ophthalmic lens is effected for moving said cutting side of said lens surfacing tool from said far edge of said ophthalmic lens to said near edge of said ophthalmic lens.

11. The method for operating an apparatus for generating an optical surface on an ophthalmic lens as claimed in claim 9 wherein said step of rotating said rotary table such that said rotatable arbor is oriented in a vicinity of said horizontal transversal axis is effected at the same time as said step of simultaneously rotating said rotary table and actuating said first linear actuator means for sweeping said cutting side of said lens surfacing tool along a prescribed base curve across said ophthalmic lens and said latter step is effected for moving said cutting side of said lens surfacing tool from said near edge of said ophthalmic lens to said far edge of said ophthalmic lens.

12. The method for operating an apparatus for generating an optical surface on an ophthalmic lens as claimed in claim 9 wherein said method also comprises a step of simultaneously moving said second movable support means along said horizontal transversal axis a transversal distance which is greater than a width of said ophthalmic lens measured along said horizontal transversal axis.

13. The method for operating an apparatus for generating an optical surface on an ophthalmic lens as claimed in claim 12 wherein said transversal distance in said step of simultaneously moving said second movable support means along said horizontal transversal axis a transversal distance which is greater than a width of said lens, plus a travel of said lens surfacing tool along said horizontal transversal axis is about 4.1 times said diameter of said ophthalmic lens.

14. The method for operating an apparatus for generating an optical surface on an ophthalmic lens as claimed in claim 9 wherein said step of simultaneously rotating said rotary table and actuating said first linear actuator means for sweeping said cutting side of said lens surfacing tool along a prescribed base curve across said ophthalmic lens comprises a moving of said first movable support means a longitudinal distance equivalent to between about 50 times to about 80 times said depth of said prescribed base curve.

15. The method for operating an apparatus for generating an optical surface on an ophthalmic lens as claimed in claim 9 wherein said method further comprises the step of moving said ophthalmic lens along said vertical axis for adding prism to said ophthalmic lens.

16. An apparatus for generating an optical surface on an ophthalmic lens, comprising:

a base having orthogonal horizontal longitudinal axis, horizontal transversal axis and a vertical axis;

a tool spindle having a motor and a lens surfacing tool mounted on a rotatable arbor of said motor for rotation by said motor;

lens holder means having chuck means for retaining an ophthalmic lens with a perimeter of said ophthalmic lens defining a plane being substantially perpendicular to said horizontal longitudinal axis, means for positioning and holding said lens holder means aside said horizontal longitudinal axis;

first linear slide means affixed to said base and having first movable support means and first linear actuator means connected to said first movable support means for moving said first movable support means along said horizontal longitudinal axis;

said means for positioning and holding said lens holder means comprising second linear slide means also affixed to said base and having second movable support means supporting said lens holder means and second linear actuator means connected to said second movable support means for moving said second movable support means and said lens holder means along said horizontal transversal axis;

rotary table means affixed to said first movable support means and supporting said tool spindle, said rotary table means having a rotary actuator means connected thereto for rotating said tool spindle about said vertical axis, computer having means for simultaneously controlling displacements of said first, second and rotary actuator means;

said lens surfacing tool having a working circumference and cutter means affixed to said working circumference; said working circumference having a cutting side for contacting said ophthalmic lens;

said tool spindle being mounted on said rotary table means with said cutting side of said lens surfacing tool being disposed at a nominal radius from said vertical axis;

such that when said lens holder means is positioned aside from said horizontal longitudinal axis and when said first and rotary actuator means are operated simultaneously for moving said cutting side across said ophthalmic lens along a prescribed base curve in said ophthalmic lens, a total displacement of said first movable support means along said horizontal longitudinal axis is greater than a depth of said base curve in said ophthalmic lens, and an actual output increment of said lens surfacing tool in a direction normal to said ophthalmic lens is smaller than an input increment of said first linear actuator means.

17. The apparatus for generating an optical surface on an ophthalmic lens as claimed in claim 16 wherein said ophthalmic lens is a circular lens having a diameter of about 70 mm, said nominal radius is about 205 mm, and said total displacement of said first movable support means along said horizontal longitudinal axis is about between 50 and 80 times larger than said depth of said base curve in said ophthalmic lens.

18. The apparatus for generating an optical surface on an ophthalmic lens as claimed in claim 16 further comprising a third slide means affixed to said second movable support means and having third movable support means connected to said lens holder means and third linear actuator means connected to said third movable support means for moving said third movable support means and said lens holder means along said vertical axis.

19. An apparatus for generating an optical surface on an ophthalmic lens, comprising:

a base having orthogonal horizontal longitudinal axis, horizontal transversal axis and a vertical axis:

a tool spindle having a motor and a lens surfacing tool mounted on a rotatable arbor of said motor for rotation by said motor;

lens holder means for retaining an ophthalmic lens with a perimeter of said ophthalmic lens defining a plane being substantially perpendicular to said horizontal longitudinal axis;

first linear slide means affixed to said base and having a first movable support and first linear actuator connected to said first movable support for moving said first movable support along said horizontal longitudinal axis;

rotary table means affixed to said first movable support and supporting said tool spindle, said rotary table means having a rotary actuator connected thereto for rotating said tool spindle about said vertical axis;

second linear slide means also affixed to said base and having second movable support supporting said lens holder means and second linear actuator connected to said second movable support for moving said second movable support and said lens holder means along said horizontal transversal axis;

computer having means for simultaneously controlling displacements of said first, second and rotary actuators;

such that said first, second and rotary actuators are simultaneously operable and controllable for moving said lens surfacing tool along a prescribed curve across said ophthalmic lens while moving said lens surfacing tool relative to said ophthalmic lens in a compound movement comprising a circular displacement of said rotary table about said vertical axis and a linear displacement of said rotary table and said vertical axis relative to said ophthalmic lens.

20. A method for operating an apparatus for generating an optical surface on an ophthalmic lens comprising the steps of:

holding an ophthalmic lens with a perimeter thereof defining a plane perpendicular to a longitudinal axis of said apparatus;

moving a lens surfacing tool about a rotation axis perpendicular to said longitudinal axis and at a fixed radius from said rotation axis, while moving said rotation axis relative to said ophthalmic lens along said longitudinal axis; and simultaneously controlling a circular movement of said lens surfacing tool about said rotation axis and a linear movement of said rotation axis along said longitudinal axis, for moving said lens surfacing tool along a prescribed curve across said ophthalmic lens;

such that a movement of said lens surfacing tool in a direction normal to said plane of said ophthalmic lens is a compound movement of a circular displacement of said lens surfacing tool about said rotation axis and a linear displacement of said rotation axis relative to said ophthalmic lens.

* * * * *